United States Patent [19]

Evans

[11] 4,028,710

[45] June 7, 1977

[54] APPARATUS FOR STEERING A RECTANGULAR ARRAY OF ELEMENTS BY AN ANGULAR INCREMENT IN ONE OF THE ORTHOGONAL ARRAY DIRECTIONS

[75] Inventor: Gary E. Evans, Glen Burnie, Md.

[73] Assignee: Westinghouse Electric Corporation, Pittsburgh, Pa.

[22] Filed: Mar. 3, 1976

[21] Appl. No.: 663,340

[52] U.S. Cl. ..... 343/854; 343/100 SA

[51] Int. Cl.[2] ..... H01Q 3/26

[58] Field of Search ..... 343/100 SA, 853, 854

[56] References Cited

UNITED STATES PATENTS

| | | | |
|---|---|---|---|
| 3,868,695 | 2/1975 | Kadak | 343/854 |
| 3,940,770 | 2/1976 | Fassett et al. | 343/854 |

*Primary Examiner*—Eli Lieberman
*Attorney, Agent, or Firm*—H. W. Patterson

[57] ABSTRACT

The steering of the beam of a rectangular directional antenna array through a small angular increment in one of the orthogonal directions of the array is achieved by the derivation and processing of a small fraction of the input power as voltage in quadrature with the unphased input power in a manner which applies a doublet of first and second opposed *j*-direction conjugal phase shifted components to a pair of subsets of radiating elements which are bilaterally symmetrically disposed on one and the other side of a centerline of the array. An unphased component of the input power is applied to a central subset of radiating elements therebetween. The processing of the small voltage in quadrature is performed in such a manner that a single selectively variable device causes controlled inversion of the doublet of conjugal voltage components applied to the radiating element subsets.

3 Claims, 9 Drawing Figures

APPARATUS FOR STEERING A RECTANGULAR ARRAY OF ELEMENTS BY AN ANGULAR INCREMENT IN ONE OF THE ORTHOGONAL ARRAY DIRECTIONS

BACKGROUND OF THE INVENTION

1. Field of the Invention

The present invention relates to apparatus for steering the beam of a two-dimensional array by a fraction of a beam width in the plane of one of the dimensions of the array. More particularly, it relates to such apparatus in which such steering is effective by actuation of a single selectively variable device. Further the invention relates to such apparatus which is amenable to applications utilizing monopulse feed in the other dimension of the array.

2. Description of the Prior Art

There is a high degree of interest in two-dimensional antenna arrays for airport approach pulsed r.f. beacons. These beacons provide directional beams which have sharp beam pattern skirts at the horizon, and are electronically steerable in the column-plane as the antenna rotates in azimuth to "hopover" rises in ground contour or local structures present at certain azimuthal bearings.

Moreover, this interest is in connection with such two-dimensional arrays which are used with azimuth monopulse feed, and which are consequently designed with separate interconnection of each of their columns to a sum channel and a difference channel. Prior to the present invention electronic column-plane steering for "hopover" required a selectively variable phase shifter for every one of the approximately 500 radiating elements of the array.

Accordingly, there has been a continuing effort to develop apparatus which provides hopover steering in the column plane of a rectangular array with fewer selectively controllable elements needed to effect the steering.

SUMMARY OF THE INVENTION

The subject of the invention is rectangular antenna array apparatus for forming a beam having directional characteristics in both its column-plane and its row-plane, and which is selectively steerable to move the beam through a small incremental range of angular movement in the column plane. The radiating elements in each column are grouped into at least three subsets comprising first and second outer subsets and a third center subset therebetween. The third center subset is centered about the array centerline in the direction of the rows, and the first and second outer subsets are disposed with bilateral symmetry to one and the other side of the centerline. The construction and operation of the apparatus will be described in terms of a transmit mode, but it is well known the apparatus will operate equally as well as in a receive mode. The r.f. input is fed to switchable quadrature component generating network which derives from the r.f. input a small fraction of the input power which is selectively invertible in phase, but always in quadrature to the unphased remainder of the input power. Two row-plane beam forming networks are provided. Both are conventional networks which divide a single input power into fixed predetermined fractions (with fixed predetermined phase modifications, if desired) to feed the respective columns of the array in a way to generate a predetermined row-plane directional beam pattern. The selectively invertible steering quadrature phased component is coupled to the input of one of these networks, and the unphase remainder component to the input of the other. The first, second, and third subsets of radiating elements are fed through first, second and third conventional column subset beam forming networks. These three networks provide respective column-plane direction beam subfields, which when added provide the desired column-plane directional beam. Their construction and operation is basically the same as the row-plane networks. Each column includes a fixed divider and conjugal phase shift doublet network between the corresponding outputs of the row-plane beam forming networks and the inputs of the first, second and third column subset beam forming networks. A predetermined fraction of unphased power is applied to the third column subset beam forming network. The remaining unphase power is applied to one of the inputs of the 4-port, 3 db coupler. The selectively reversible quadrature phased component is connected to the other input of the 4-port, 3 db directional coupler. There are produced at the two outputs of the coupler a doublet of first and second conjugal composite phase shifted voltage components. One of the output ports is coupled to the input of the first column subset beam forming network, and the other output port applied to the input of the second column subset beam forming network. Thus the first and second outer subset of radiating elements will radiate one and the other of opposed *j*-direction conjugal phase shifted voltage components. Upon the actuation of the switchable quadrature component generating network to reverse the phase of its output, the first and second subsets of radiators will radiate the other and the one of the opposed *j*-direction conjugal voltage components. The phase shifts of the doublet of conjugal phase shift components are small and the phase slope of energy radiated from the individual radiators is a three-level stepped phase front which approximates a small phase slope. Selective reversal of this approximated phase slope provides steering between limits established by the reversible conjugate phase components applied to the first and second subsets of the columns of the array.

DESCRIPTION OF THE PREFERRED EMBODIMENT

Figure 1:
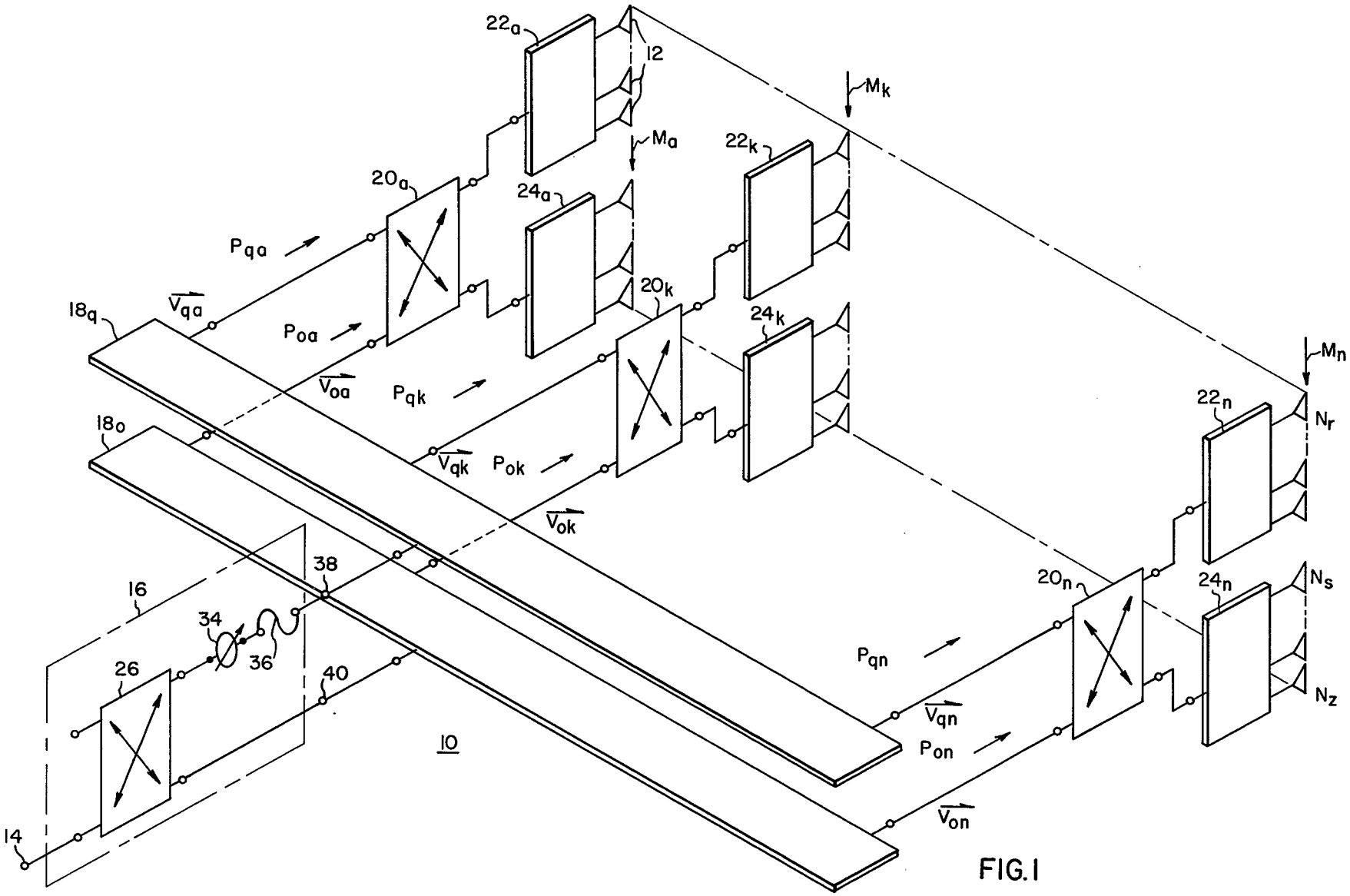
FIG. 1 is a block diagram of hypothetical selectively steerable rectangular array antenna which employs a hypothetical two-level stepped phase slope mode of operation, this hypothetical two-level stepped phase slope mode of operation being useful in explaining the principle of the invention.

Referring now to the drawing and in particular to FIG. 1, an antenna system 10 comprises a rectangular array of radiating elements and an associated organization of components constituting a feed network. System 10 is selectively switchable to provide a capability of electronically steering the directional beam of the array between limit positions of an angular steering increment in the column-plane. An example of a use of an antenna system having this capability is in beacon antenna equipment for radar surveillance of aircraft approaching airports. In such uses it is sometimes desired to steer the beacon beam slightly up and down as the antenna apparatus rotates in azimuth to avoid reflections from rises in ground contour or local structures. This slight up and down steering of the beam is commonly called "hopover", and a typical magnitude of steering would be 2°. The rectangular array comprises a plurality of individual radiating elements 12 arranged in a set of vertical rows $M_a, \ldots M_k, \ldots M_n$; and a set of horizontal rows $N_r, N_s \ldots N_z$. It is to be understood that an airport beacon antenna typically has 500 individual radiating elements, so that there are on the order of 20 columns M and 20 rows N. Antenna systems 10 has a single r.f. feed input terminal 14.

Briefly, there is disposed between terminal 14 and the individual radiating elements an organization of components for fixed power distribution and switchable phase modification composed of four stages.

The first stage is a switchable quadrature component network 16, which derives from the r.f. input a small fraction of the input power which is quadrature phase relationship to the remainder of the input power. The remainder of the input power is designated the reference or unphased component. Network 16 is switchable to provide the quadrature component in selectively invertible phase. The second stage is a pair of row-plane multiple branching power dividers $18_q$, and $18_o$. Power dividers $18_q$ and $18_o$ respectively receive the quadrature phased component and the unphased component. Power dividers $18_q$ and $18_o$ each form a respective set of outputs for feeding to the individual columns M of radiating elements. The third stage is a set of 4-port, 3 db directional couplers 20 employed as a device for forming a conjugal doublet of phase-shifted components at the one and the other of its two output ports. The set is comprised of one such coupler for each column M. The individual directional couplers 20 are designated on the drawing with the subscript letter of the corresponding column. In system 10 depicted in FIG. 1 the upper and the lower halves of each column M of radiating elements are grouped into upper and lower half subsets. As will be appreciated as the description proceeds, the division of the columns into only two half-column subarrays is for the purpose of simplicity of explanation of the principle of the invention. The preferred embodiment, illustrated in FIG. 4A has a third central subset between two outer subsets. The fourth stage comprises a set of pairs of upper and lower column-plane multiple branching power dividers 22 and 24. The set comprises a pair for each column M of radiating elements. Individual upper and lower power dividers 22 and 24 are designated on the drawing with the subscript letter of the corresponding column. The input ports of the upper power dividers 22 and the input ports of the lower power dividers 24 are connected to one and the other of the output ports of the directional coupler 20 for the corresponding column. The outputs of power dividers 22 and 24 are connected to the individual radiating elements 12 of the respective upper and lower subsets of the corresponding column.

Figure 2A:
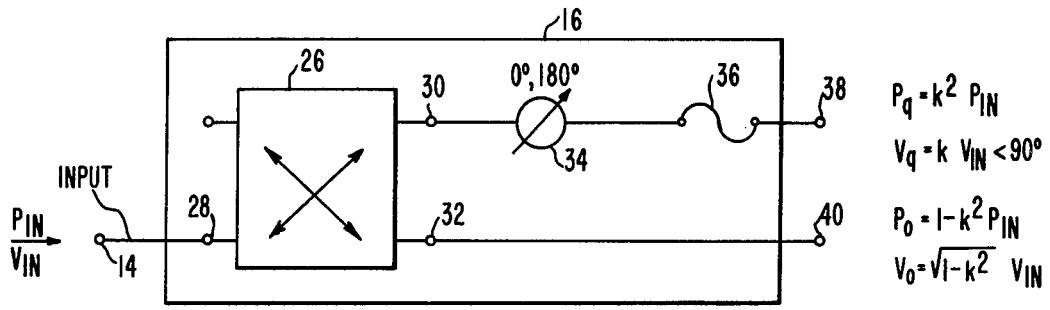
FIG. 2A is a detail of the switchable quadrature component generating network of FIG. 1.
Figure 2B:
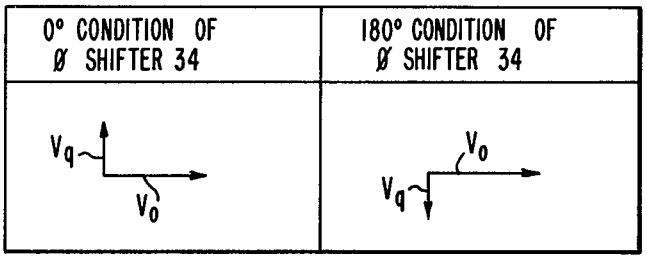
FIG. 2B is a pair of vector diagrams illustrating the nature of the output of this network.

Reference is now made to FIG. 2A for a detailed description of the switchable quadrature component generating network 16. The network 16 includes a 4-port directional coupler 26 providing very weak coupling coefficient, $k^2$, (where $k$ is a number less than unity). The r.f. input terminal 14 is applied to an input port 28 of coupler 26. The other input port is not connected to anything. The weak directional coupling properties of coupler 26 provide a small fraction, $P_q = k^2P_{IN}$, at coupler output port 30. The remainder of the input power, which is used as an unphased component $P_o$, appears at the other output port 32. In magnitude, $P_o$ equals $1 - k^2P_{IN}$. Directional couplings with weak directional coupling capability are conventional and well known in the art. After emerging at output port 30 the fractional component passes through a 0°, 180° switchable phase shifter 34 and thence to a fixed phase shift element 36 chosen to place the voltage component $V_q$ at the output terminal 38 of network 16 in quadrature relationship with the unphased voltage component $V_o$ from coupler output terminal 32. Terminal 32 is connected to a terminal 40 of network 16. The switchable phase shifter 34 selectively inverts the component $V_q$ thereby selectively causing it to be a leading or a lagging quadrature phase component relative to unphase component $V_o$. The overall operation of network 16 is to derive a small fraction $k^2$ of the input power which is selectively invertible in phase, but always in quadrature relation to the unphased voltage component $V_o$. Exemplary relationships of $V_q$ and $V_o$ when switchable phase shifter 34 is in its 0° and 180° conditions are shown in the vector diagrams of FIG. 2B. As will become apparent as the description proceeds the switch condition of phase shifter 34 controls the steering of the beam. For example in the use of system 10 for an airport beacon requiring hopover, external means not part of the invention will actuate phase shift 34 to selectively steer the array beam up and down in the column plane as the array rotates in azimuth.

Referring again to FIG. 1, output terminal 38 of quadrature component network 16 is coupled to the input port of the multiple branching power divider $18_q$, and the output terminal 40 to the input port of the multiple branching power divider $18_o$. Dividers $18_q$ and $18_o$ are each conventional well known constructions for dividing their respective power inputs into predetermined fixed fractions which when radiated from the respective columns $M_a, \ldots M_n$ provide a predetermined row-plane directional beam pattern. The resulting signals at the output terminals are for divider $18_q$ designated $V_{qa}, \ldots V_{qk}, \ldots$ and $V_{qn}$; and for divider $18_o$ are designated $V_{oa}, \ldots V_{ok}, \ldots$ and $V_{on}$. Dividers $18_q$ and $18_o$ may additionally introduce predetermined fixed phase modifications in the outputs to the respective columns, also to the end of providing a desired row-plane directional beam pattern.

Figure 3B:
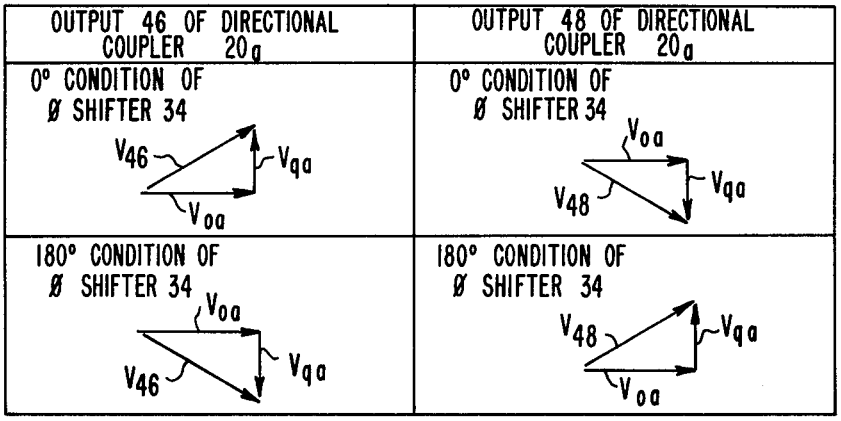
FIG. 3B is a set of vector diagrams illustrating the nature of the output of the 4-port, 3db directional coupler.
Figure 3A:
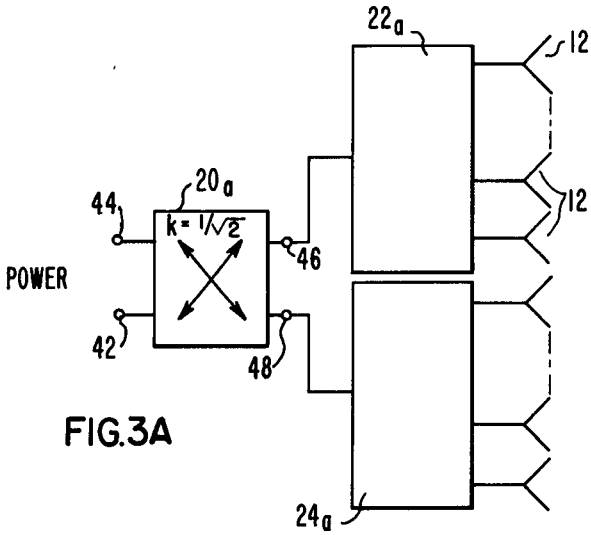
FIG. 3A is a detail of the 4-port 3 db directional coupler, the upper and lower half-column subset beam forming network, and the upper and lower half-column subsets of radiator of one of the columns of the apparatus of FIG. 1.

Reference is now made to FIGS. 1, 3A and 3B, for details of the fourth stage comprising the set of 4-port, 3 db directional couplers $20_a \ldots 20_n$. These are conventional, well-known devices which are sometimes known as $k = 1/\sqrt{2}$ type directional couplers, where $k$ is the coupling coefficient. The coupler for the column $M_a$, namely coupler $20_a$ will be described, it being understood that the discussion is equally applicable to the other couplers of the set. Input port 42 of coupler $20_a$ receives the share $P_{oa}$ of the unphased power $P_o$, for column $M_a$. Input port 44 receives the share $P_{qa}$ of the small fraction of power $P_q$ from network 16. This received power $P_{qa}$ has a quadrature voltage phase $V_{qa}$ which is either in a leading quadrature relationship or a lagging quadrature relationship depending on the condition of switchable phase shifter 34. There are provided at the two outputs 46, and 48, of coupler $20_a$ the sum and difference respectively of the two inputs. As illustrated in FIG. 3B, in the 0° condition of switchable phase shifter 34 output 46 of coupler $20_a$ provides a positive $j$-component so that the composite voltage $V_{46}$ has a small (exaggerated in the diagram) positive phase shift. Output port 48 provides small negative phase shift composite voltage $V_{48}$. Upon inverting the voltage $V_q$ by actuating phase shifter 34 to its 180° condition the quadrature components invert such that output 46 has a negative phase shift and output 48 has a positive phase shift. It will be appreciated that the selectively invertible quadrature phase of $V_q$ from terminal 38 of network 16 has been processed to provide a conjugate doublet of components phase shifted by equal small angles from the unphased condition. Further, this conjugate doublet is selectively invertible depending upon the condition of switchable phase shifter 34. Stated another way, the outputs at terminals 46 and 48 are conjugate doublets of phase shifted voltage components which are selectively reversible.

Figure 3C:
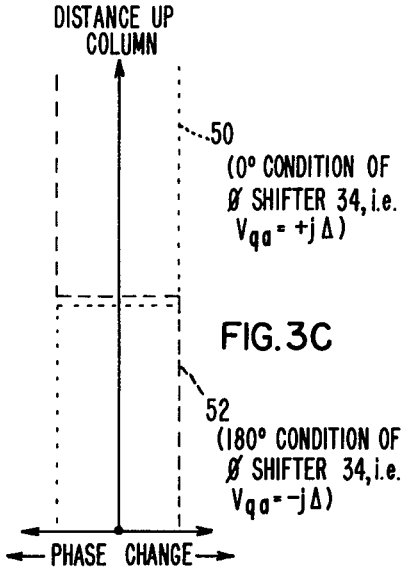
FIG. 3C is a diagrammatic representation of the phase slope of radiated energy produced by the organization of components of FIG. 3A.

Reference is now made to FIG. 1, 3A and 3C for details of the structure and operation of the fourth stage consisting of the set of pairs of multiple branch power dividers 22 and 24. Again, it is to be understood that the discussion relative to the dividers $22_a$ and $24_a$ for column $M_a$ is applicable to all the other power divider pairs of the set. Multiple dividers $22_a$ and $24_a$ are of the same basic construction as dividers $18_q$ and $18_s$, except that the pair $22_a$ and $24_a$ cooperated to provide a column-plane direction beam pattern of radiation produced by column $M_a$. The set of pairs for all the columns produced the composite column-plane directional beam pattern. Upper multiple branch power divider $22_a$ distributes predetermined fractions of its power input (and may provide predetermined phase modifications also) to the respective radiating elements 12 in the upper half of column $M_a$. The phase shift component, namely $$(\vec{V}_{oa} + \vec{V}_{qo})/2,$$

From terminal 46 of coupler $20_a$ is applied to the input of divider $22_a$. Lower multiple branch power divider $24_a$ likewise distributes predetermined fractions (and possibly provides individual phase modifications) to the respective radiating elements of the lower half of column $M_a$, and the phase shifted voltage component, namely $$(\vec{V}_{oa} - \vec{V}_{qa})/2,$$

is applied to its input. Thus one and the other of the conjugate doublet of phase shifted voltage components radiate from the upper and lower radiating elements. The result is that column $M_a$ of radiating elements has a variation in radiated phase along the column in accordance with dotted line 50, FIG. 3C, when switchable phase shifter 34 is in its 0° condition. The input to divider $22_a$ has a positive $j$-component and the input to divider $24_a$ has a negative $j$-component. This produces a phase front steered slightly up from perpendicular to the physical plane of the rectangular array. In the 180° condition of switchable phase shifter 34 the opposite is true producing a variation in phase along the column in accordance with dashed line 52. The phase front is steered slightly down from normal. Every column of the set of columns M is similarly steered. Consequently, the entire array is selectively steerable by selective control of switchable phase shifter 34 in small quadrature component network 16. The energy radiating from the radiating elements 12 of the rectangular array has passed through power dividers $18_q$ and $18_o$, and through their respective column power dividers of the set $22_a \ldots 22_n$ or the set $24_a \ldots 24_n$. Therefore magnitudes of their respective radiated power (and possibly phase modification of respective radiated power) will form the desired directional beam patterns in the column and row planes.

It is to be appreciated that the provision of two multiple branch power dividers $18_s$, and $18_o$ through which all transmitted energy (or all received energy in the receive mode) from the radiators passes, makes system 10 amenable for use in azimuth monopulse radar systems. As will be appreciated by those of average skill in art of pulsed radar systems, azimuth monopulse operation is obtained by the separate interconnection of each column of the array to one and the other of a sum channel, and a difference channel. Multiple branch power dividers $18_q$ and $18_o$ act as convenient terminal board means for individual connection of the monopulse channels to each column of the array. This enables system 10 to be incorporated into a monopulse radar system without the necessity of separate individual connections to every single radiating element of the array and moreover the necessity of separate adjustment of phase in each radiating element line for hopover steering.

It is to be appreciated that the nominal unsteered position of the beam of system 10 is not in the direction normal to the physical frontal plane of the array. Instead, the beam pattern which results from the phase slope of dashed line 52, FIG. 3C, is the unsteered position, and that which results from the phase slope of dotted line 50 is the upward, or hopover, steered position.

Figure 4A:
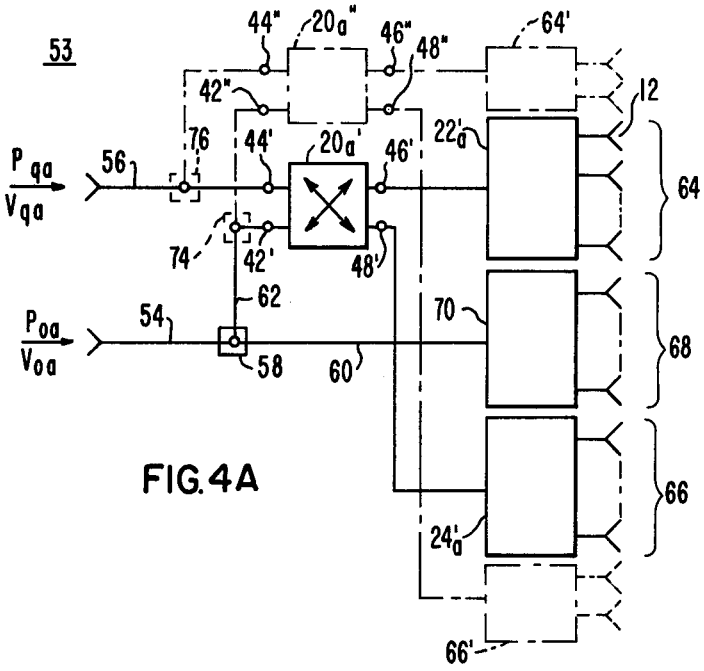
FIG. 4A is a block diagram like that of FIG. 3A, but of an organization of components for a three-level stepped phase slope apparatus of the preferred embodiment, and further showing in phantom lines the organization of components for a five-level stepped phase slope.
Figure 4B:
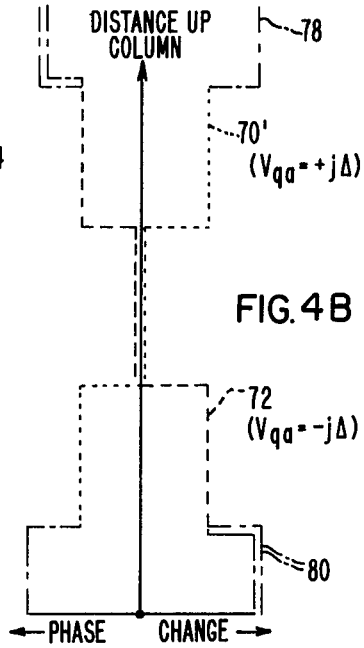
FIG. 4B is a diagrammatic representation of the phase slope of radiated energy produced by the organization of components of FIG. 4A.

System 10 is completely feasible in the event that beam steering with only two phase conditions (i.e., a two-level stepped phase front) across a column is desired. However, it will be readily apparent that the system could be constructed by simply moving the directional coupler which produce the conjugal phase shifted voltages to an earlier position in the sequence of stages, and then separately feeding the upper and lower halves of the array. The reason for disclosing system 10 is to simplify the explanation of the operation of a preferred embodiment of the invention having a three-level stepped phase slope. This preferred embodiment will now be described with reference to FIGS. 4A and 4B. FIG. 4A shows an organization 53 of the third and fourth stages which disclose the preferred embodiment. The first, second and third stages are the same as in FIG. 1. Again, apparatus relating to only a single column, $M_a$ will be described, it being understood that the description is applicable to all other columns of the set.

The share of power $P_{oa}$ of unphased voltage $V_{oa}$, which is allocated for column $M_a$ appears at the corresponding output port of power divider $18_o$. From there it is applied to an unphased component input lead 54. The share of power $P_{qa}$ of quadrature phase voltage $V_{qa}$ which is allocated for column $M_a$ appears at the corresponding output port of power divider $18_q$. From there it is applied to an quadrature component input lead 56 which is connected to an input port 44 of a 4-port, 3 db directive coupler $20_a$. Lead 54 is applied to the input of a non-directional power divider 58 which divides the unphased power component into a predetermined fraction which passes out of divider 57 along output line 60, and another predetermined fraction which passes out along output line 62. For purposes of illustration it will be assumed that 40% of the power received on line 54 is directed along output line 60 and 60% is directed along output line 62.

The radiating elements 12 of column $M_a$ are grouped in three subsets comprising first and second subsets 64 and 66, each of which contain a like number of radiating elements and are disposed with bilateral symmetry to one and the other side of the midpoint of the column. A third subset of radiating element 68 is centrally disposed between the first and second subsets with its individual radiating elements centered with respect to the midpoint of the column. Middle subset of radiating elements are fed by a branching power divider 70. Lead 60 is coupled to its input side. Lead 62 out of non-directional coupler 58 is connected to input 42' of directional coupler $20_a'$. Directional coupler $20_a'$ operates the same as described for the direction coupler $20_a$ of the simplified case of FIG. 1. It provides at its outputs 46' and 48' conjugate phase shifted voltage components, which are selectively invertible in accordance with the condition of switchable phase shifter 34 in the first stage. An upper subset branching power divider $22_a'$ and a lower subset branching power divider $24_a'$, respectively, receive the conjugate doublet of phase components from terminals 46 and 48, and distribute the power to the radiating elements of subsets 64 and 66, respectively. What is achieved with organization 53 is a three-level stepped reversible phase front indicated by dotted line 70' for the condition of $V_{qa}$ having a positive *j*-component, and indicated by dashed line 72 for the condition of $V_{qa}$ having a negative *j*-component. The approximation provided by a three-level phase slope is adequate where an increment of angular steering motion of the order of 2° or less is desired.

The organization 53 may be adapted to provide additional steps of phase slope through one or more successively outer subsets 64' and 66' (shown in phantom line) of radiators. This is done by dividing the inputs $V_{oa}$ and $V_{qa}$ into one or more additional pairs of input for one or more additional directional couplers. For example, an additional pair of non-direction power dividers 74 and 76 (in phantom) may be provided in lines 62 and 56, respectively. Each have outputs connected to input ports 42'' and 44'' of an additional 4-port, 3db directional coupler $20_a''$ (in phantom). Nondirectional power dividers 74 and 76 are adapted to provide to input terminals 42'' and 44'' equal fractions of $V_{oa}$ and $V_{qa}$ which are greater than the fractions applied to input terminals 42' and 44' of directional coupler $20_a'$. This results in the appearance at outputs 46'' and 48'' of doublets of conjugate phase shift components of greater phase change than that of coupler $20_a'$. Like the doublet from directional coupler $20_a$; the doublet at the output of directional coupler $20_a''$ is selectively inverted in accordance with the condition of switchable phase shifter 34. In this manner additional phase steps indicated by a single phantom line 78 and by a double phantom line 80 may be obtained without requiring additional components in the first three stages of a system.

Figure 5:
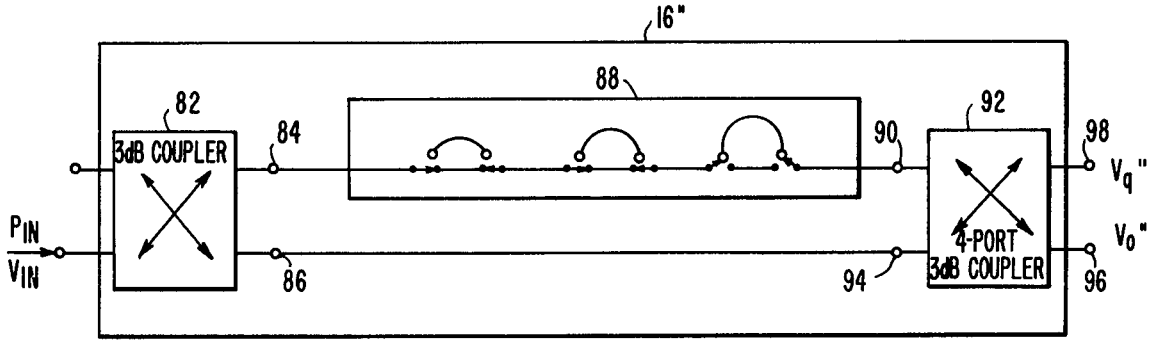
FIG. 5 is a block diagram like that of FIG. 2, showing an alternate construction of switchable quadrature component generating network which selectively produces different magnitudes of quadrature phased components.

Reference is now made to FIG. 5 which shows an alternate embodiment of quadrature component network 16''. A conventional 3 db directional coupler 82 divides the input equally between an output terminal 84 and an output terminal 86. The output of terminal 84 is applied to a 3-bit variable binary phase shifter 88 which is actuable by switching action to connect in series various combinations of three discrete magnitudes of delay line to selectively provide a phase shift from among the possible combinations of the three different delay magnitudes. Such apparatus is conventional and well known. The output terminal of variable binary phase shifter 88 is connected to an input terminal 90 of another 4-port 3 db directional coupler 92. Output port 86 of coupler 82 is directly coupled to the other input port 94 of coupler 92. The two components of the r.f. input from coupler 82 are recombined in a coupler 92. A 0° phase shift in the links between the output terminals of the first coupler and input terminals of the second coupler cause all of the power recombines at an output terminal 96 of coupler 92. Small phase shifts in the link between terminal 84 and terminal 90 cause a small, proportional fraction of quadrature phased power to appear at an output terminal 98 of coupler 92. The quadrature phased power component is in a leading or lagging phase relationship depending upon whether the phase shift in the link between output port 84 of coupler 82 and input port 90 of coupler 92 is positive or negative. Thus, the various phase shifts provided by different settings of variable binary phase shifter 88 produce a corresponding number of predetermined different magnitudes and directions of *j*-component of quadrature phased output $V_q''$ at terminal 98. These result in a plurality of phase shift magnitudes of the doublet of conjugal phase shifted components in the subsequent stages of a system, with corresponding different gradients of phase slopes of radiated energy.

Although the present invention has been described with reference to the array in which it was desired to steer the beam in the column-plane which corresponded to the elevation plane, it will be readily appreciated that the same principle would apply to steering in the azimuthal plane by interchanging the components to interact with the row plane of the array in the way specified herein for the column plane. Sealed another way the radiating elements in the azimuthal directions could be designated columns, and the teachings of the specification applied directly.

The description of the antenna system apparatus herein has been stated in terms of the transmission mode of operation. However, it will be understood that the disclosed antenna system also operates in the receive mode. Accordingly, in the interpretation of this specification and of the claims appended hereto, it will be appreciated that utilization on both modes is intended. It is an accepted practice in the art of antenna systems to describe the system in terms of the transmit mode, where applicability to both a transmit and a receive mode is intended.

I claim:

1. In a directional antenna array of the type having radiating elements aligned in a rectangular arrangement of rows and columns, the directional beam of said array being selectively steerable between limit positions spaced apart by at least one predetermined angular increment in the column plane, the combination:

a. a plurality of radiating elements arranged in a rectangular array in which the elements are aligned in a set of rows and a set of columns, each column of the set of columns comprising first, second and third subsets of radiating elements, said first and second subsets of each column having like numbers of radiating elements and being disposed with bilateral symmetry to one and the other side of the midpoint of the column, said third set of radiating elements being centrally disposed between the first and second subsets and being centered relative to the midpoint of the column, b. an array input terminal for receiving r.f. energy, c. first column-plane beam steering means operative to feed a reference unphased voltage component of said r.f. energy to said third subset of radiating elements and operative to derive from said r.f. energy a selected one of first and second invertible relationships of a doublet of first and second conjugal phase shifted voltage components, and to apply said first and second conjugal voltage components to said first and second subsets, respectively.

2. Apparatus in accordance with claim 1, wherein;

a. said first column-plane beam means further includes (i) second switchable means for deriving from a single r.f. energy input a selectively invertible quadrature phase voltage component and a reference phase voltage component; (ii) third means for forming a row-plane directional beam pattern; (iii) a set of fourth means for deriving from a pair of input voltage components in quadrature phased relationship a pair of output voltage components comprising a conjugal doublet of phase shift voltage components; and (iv) fifth means for forming a column-phase directional beam pattern;

b. said second switchable means having an input connected to said array input terminal, and having first and second outputs, said second selective means being operable to provide a selectively invertible quadrature phased voltage component at said first output and to provide a reference unphased voltage component at said second output, the magnitude of power of said component at said first output being a predetermined small fraction of the magnitude of the power of the component at said second output;

c. said third means comprising first and second row-plane beam forming networks, said first and second row-plane beam forming networks each having an input, and each having a set of outputs comprising an output for each column of radiating elements, the input of the first row-plane beam forming network and the input of the second row-plane beam forming network being connected to the first and second outputs, respectively, of said second switchable means;

d. said set of fourth means comprising a fourth means for each column of radiating elements, each fourth means of said set having first and second inputs, each first input of each fourth means being connected to the output of the first row-plane beam forming network for the corresponding column, each second input of each fourth means being connected to the output of the second row-plane beam forming network for the corresponding column, each fourth means of said set having first, second and third outputs and being operative to provide at its first and second outputs one and the other of conjugal composite phase shifted voltage components of the voltage components received at its first and second inputs, respectively, and being operative to provide at its third output an unmodified portion of the output of the second row-plane beam forming network;

e. said fifth means comprising a set of pairs of first and second column subset beam forming networks, and a third column subset beam forming network, said set comprising such first, second and third networks for each column of radiating elements, f. the first subset beam forming network of each pair having an input connected to the first output of the fourth means for the corresponding column, and having a set of outputs comprising an output for each radiating element of the first subset of the corresponding column, each output of the set of outputs being connected to the corresponding radiating element of the first subset of the corresponding column, g. the second subset beam forming network of each pair having an input connected to the second output of the fourth means for the corresponding column, and having a set of outputs comprising an output for each radiating element of the second subset of the corresponding column, each output of the set of outputs being connected to the corresponding radiating element of the second subset of the corresponding column, and h. each third column subset beam forming network having an input connected to the third output of the fourth means, and having a set of outputs comprising an output for each radiating element of the third subset of the corresponding column, each output of the set of outputs being connected to the corresponding radiating element of the third subset.

3. Apparatus in accordance with claim 2, wherein;

a. said second switchable means further being operative to select said predetermined small fraction of the component from among at least two different predetermined small fractions.

* * * * *